US010041263B2

(12) United States Patent
Vicious et al.

(10) Patent No.: US 10,041,263 B2
(45) Date of Patent: Aug. 7, 2018

(54) METHODS AND SYSTEMS FOR FIXING HOLES

(71) Applicant: Plus54 Innovations LLC, Buffalo, WY (US)

(72) Inventors: Chris Vicious, Las Vegas, NV (US); Jorge Ordonez Maluf, Las Vegas, NV (US)

(73) Assignees: Chris Vicious, Las Vegas, NV (US); Jorge Ordonez Maluf, Las Vegas, NV (US)

( * ) Notice: Subject to any disclaimer, the term of this patent is extended or adjusted under 35 U.S.C. 154(b) by 0 days.

(21) Appl. No.: 15/464,331

(22) Filed: Mar. 20, 2017

(65) Prior Publication Data

US 2017/0268244 A1 Sep. 21, 2017

Related U.S. Application Data

(60) Provisional application No. 62/310,091, filed on Mar. 18, 2016.

(51) Int. Cl.
*E02D 37/00* (2006.01)
*E04G 23/02* (2006.01)

(52) U.S. Cl.
CPC ..... *E04G 23/0211* (2013.01)

(58) Field of Classification Search
CPC ..... E04G 23/0207; E04G 23/0211
USPC ..... 52/514, 514.5
See application file for complete search history.

(56) References Cited

U.S. PATENT DOCUMENTS

| | | | |
|---|---|---|---|
| 3,583,122 | A | 6/1971 | Biegajski |
| 3,834,107 | A | 9/1974 | Standing |
| 4,100,712 | A | 7/1978 | Hyman |
| 4,193,243 | A | 3/1980 | Tiner |
| 4,285,183 | A | 8/1981 | Condit |
| 4,297,823 | A | 11/1981 | Keisler |
| 4,354,332 | A | 10/1982 | Lentz |
| 4,370,842 | A | 2/1983 | Martin et al. |
| 4,406,107 | A | 9/1983 | Schoonbeck |
| 4,408,429 | A | 10/1983 | Neal |
| 4,848,056 | A | 7/1989 | Kelly |
| 5,018,331 | A | 5/1991 | Forzano |
| 5,033,949 | A | 7/1991 | Jewett |
| 5,960,603 | A | 10/1999 | Redden et al. |
| 6,044,613 | A | 4/2000 | Crafts et al. |
| 6,347,496 | B1 | 2/2002 | Pinkins |
| 6,508,040 | B2 | 1/2003 | Nelson |
| 8,024,903 | B2 | 9/2011 | Riggs |
| 8,615,949 | B2 | 12/2013 | Georgievski |
| 8,776,470 | B2 | 7/2014 | Karam et al. |

(Continued)

*Primary Examiner* — Charles A Fox
*Assistant Examiner* — James Buckle, Jr.

(57) ABSTRACT

A system for fixing an opening within a structure includes a planar front member including an opening, a rear member including first and second outer portions and a central portion connected at a pivot point. The first and second outer portions include first and second hooks, respectively, adjacent to the pivot point. A spring extends between the first and second hooks. The first and second outer portions includes first and second elongated slots and the central portion includes a slot. The system further includes a handle including a body, and the body of the handle is threaded through the first and second elongated slots and the slot of the rear member and the opening of the front member.

9 Claims, 14 Drawing Sheets

(56) References Cited

U.S. PATENT DOCUMENTS

| | | | | |
|---|---|---|---|---|
| 9,637,940 | B2 * | 5/2017 | Naylor | E04G 23/0203 |
| 2002/0083679 | A1 | 7/2002 | Hanner | |
| 2005/0086889 | A1 * | 4/2005 | Shock | E04G 23/0203<br>52/514 |
| 2006/0059829 | A1 | 3/2006 | Flynn | |
| 2013/0125493 | A1 * | 5/2013 | Raheel | E04G 23/0207<br>52/514 |
| 2015/0184406 | A1 * | 7/2015 | Naylor | E04G 23/0207<br>52/514 |

* cited by examiner

METHODS AND SYSTEMS FOR FIXING HOLES

CROSS-REFERENCE TO RELATED APPLICATIONS

This application incorporates by reference and claims the benefit of priority to U.S. Provisional Application No. 62/310,091 filed on Mar. 18, 2016.

BACKGROUND OF THE INVENTION

The present subject matter relates generally to methods and systems for fixing holes in surfaces, such as walls and doors, using an in-situ injection-mold kit and technique.

When a homeowner is tasked with fixing a hole in a wall or other structure, the do-it-yourself (DIY) options require time, money, and a certain level of knowledge and/or skill to properly execute. Even to fill a simple hole, the homeowner must research the best practices and techniques, review the various products that could be used, and spend the necessary time to fix the hole (often more time than expected). In order to fix the hole, each of these steps tends to be time-consuming.

Even with more experienced tradesmen in the construction industry, minor fixes such as filling a hole within wall can add unnecessary delay resulting in an increase in cost and time to a project. Such a fix requires the tradesman's attention to the preparation of the area to be fixed, the coordination of materials, the mixing of fill material, the application of the materials, time to cure, then sanding the area down in an attempt to mimic the original shape of the surface. In various situations, a minor fix such as this could stop the overall project until the task is finished; moving of any electrical outlet, switch, lighting fixture, cabling, alarms and detectors, fans, plumbing inlets/outlets, and a slew of other repair/renovation/restoration projects.

Additionally, fixing a single hole such as that created by a doorknob, typically requires much less material than is provided by the saleable amount of materials so excess unused materials are leftover and wasted in nearly each instance. Even the more experienced homeowners, handymen, and professionals experience some of these problems.

Currently available DIY kits include a structure or material to cover the hole, such as a patch, a screen, or a piece of tape, that then require compound to be applied on top of the mask, rendering a cover-up instead of a restoration, thus not truly a fix. These solutions leave a raised surface and even after painting over the material, the results are visually unappealing.

Accordingly, there is a need for a system for fixing a hole in a wall or other structure that provides high quality results by actually restoring the surface to its original shape, is easy to use and dramatically minimizes the amount of time required to complete.

BRIEF SUMMARY OF THE INVENTION

To meet these needs and others, the present disclosure provides a system and method for fixing a hole in a structure, such as a wall, where the hole is enclosed so as to create a mold, filled with a compound, and then exposed so that the cured compound in the hole is coplanar with the surrounding wall. Once the mold is filled it easily blends in with the structure. The systems and methods may be used on a cavity formed in a variety of materials of interior and exterior surfaces, such as drywall, plaster, wood, concrete, cinder blocks, brick, and the like. Examples of structures comprised of these materials include, but are not limited to, walls, doors, and ceilings.

For purposes of this description, the system will be described as applied to a hole formed in a wall including a rear surface and a front surface. In a preferred embodiment, the system includes a back member and a front member positioned to surround the hole in the wall to create the mold. The back member of the system is adjustable so that it can be compressed for insertion through the hole and then expanded to extend along the rear surface of the structure surrounding the hole. A handle protrudes from the back member through the hole of the wall towards the user, allowing the user to position the back member relative to the rear surface. In some embodiments, the handle extends from a central location on the back member. The handle may attach to the back member at any number of points and at any location on the back member as desired or necessary.

The front member is a planar piece with a centrally located slot or opening, a locking mechanism, and a closable fill channel. Holding the back member in position using the handle, the user feeds the handle through the opening of the front member and moves the front member towards the hole so that it sits against the front surface of the structure. Once positioned around the hole, the back and front members create the mold.

The user then fills the mold with a compound such as foam, spackle, or plaster. The system may include a tube or other container that allows for easy injection of the compound into the mold. As the compound cures, it binds to the exposed interior surface of the structure forming the hole. Once the compound is at least partially cured, the user removes the front member, cuts the handle to a length that is flush with the front surface of the wall, pushes the handle into the compound-filled mold, and fills the void left by the insertion of the handle with compound. Light sanding may be required to match the filled slot as well as to remove any 'crust' formed around the perimeter of the mold.

One objective of the present application is to provide a system and method for fixing a hole that is simple and efficient to use and saves the user a significant amount of time, without requiring the user to research techniques and/or tools and materials or to purchase materials that are typically offered in excess of what is actually needed.

An advantage of the present application is the smooth finish on the fixed hole that provides a visually appealing restored surface on the structure.

A further advantage of the present application is the ability to minimize excess materials remaining after a repair is complete.

A still further advantage of the present application is that the efficient construction provides a smaller learning curve for the user, creating a lower barrier to entry for those attempting do-it-yourself repairs.

Additional objects, advantages and novel features of the examples will be set forth in part in the description, and in part will become apparent to those skilled in the art upon examination of the following description and the accompanying drawings or may be learned by production or operation of the examples. The objects and advantages of the concepts may be realized and attained by means of the methodologies, instrumentalities and combinations particularly pointed out in the appended claims.

DETAILED DESCRIPTION OF THE INVENTION

Figure 1:
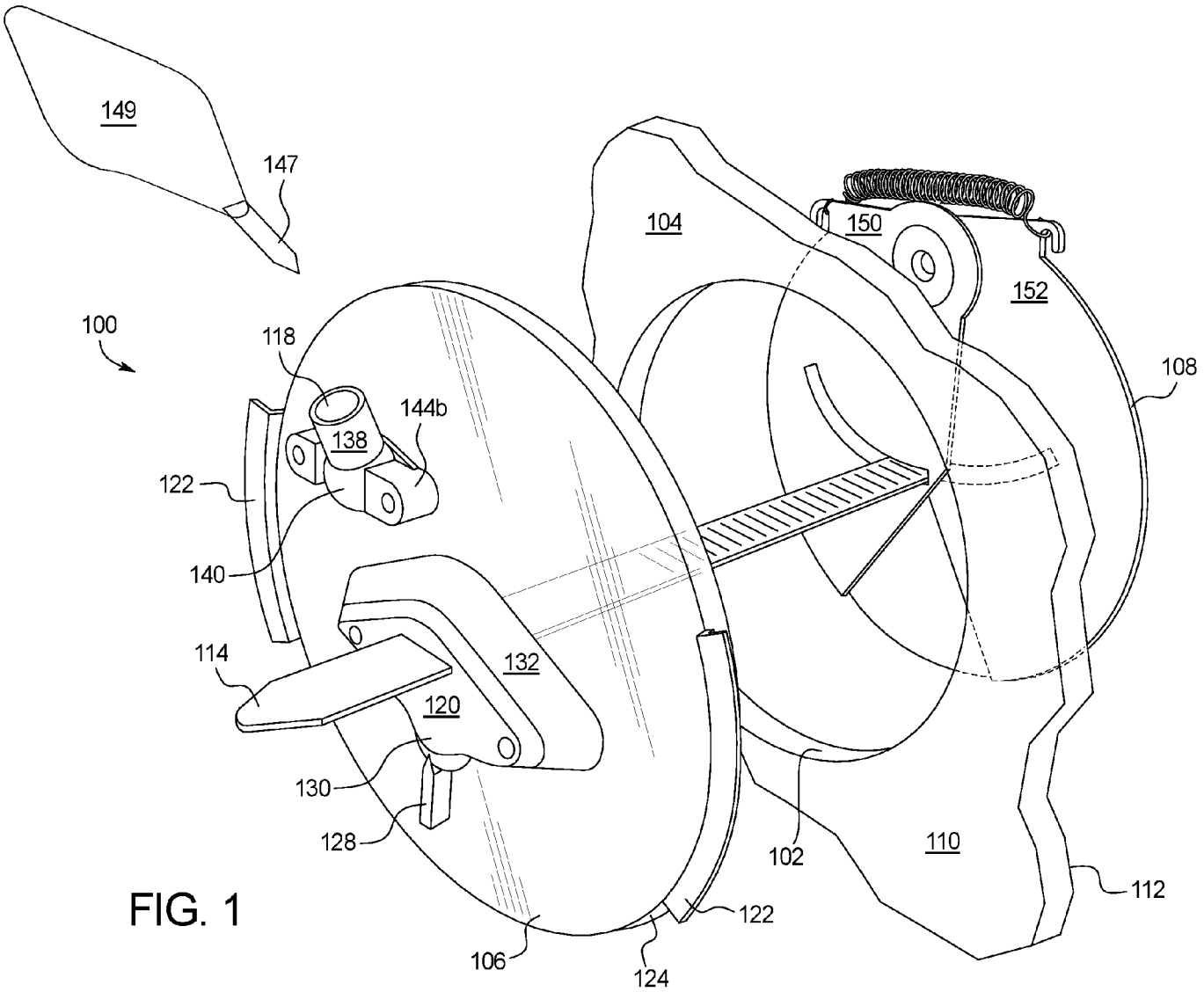
FIGS. 1 and 2 are a front and rear exploded, perspective views of the system of the present application.
Figure 2:
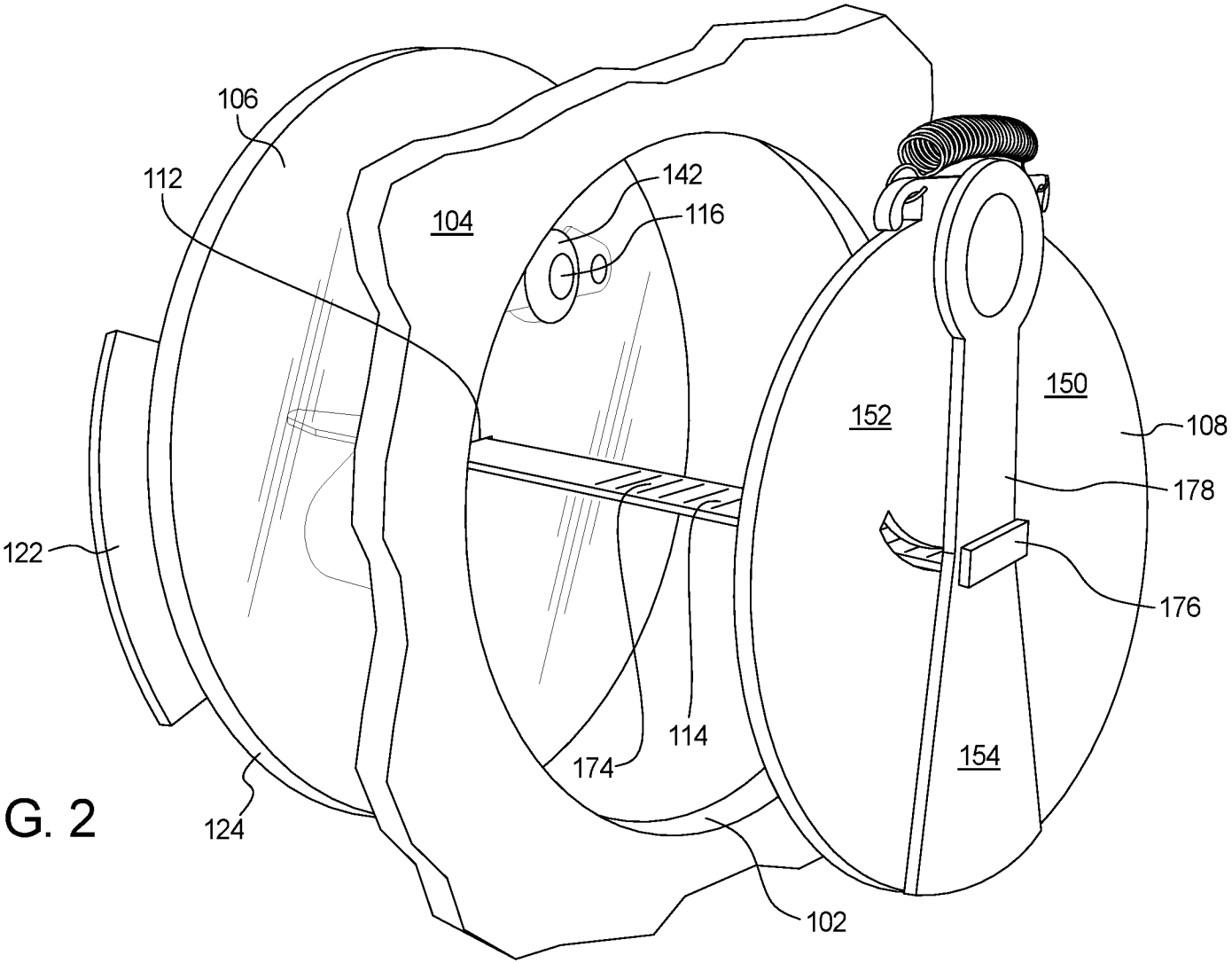

FIGS. 1 and 2 illustrate an example of a system 100 for fixing a hole 102 in a wall 104, where the hole 102 is enclosed within the system 100 so as to provide a mold, filled with a filler compound, and exposed so that the cured compound in the hole is coplanar with the surrounding wall. As shown in FIGS. 1 and 2, the system 100 includes a front member 106 and a rear member 108 that enclose the hole 102 within the structure 104 to create the mold. Once the compound has at least partially cured, the front member 106 is removed so that an exposed surface of the filled hole 102 is coplanar with a front surface 110 of the structure 104 surrounding the hole 102.

Figure 3:
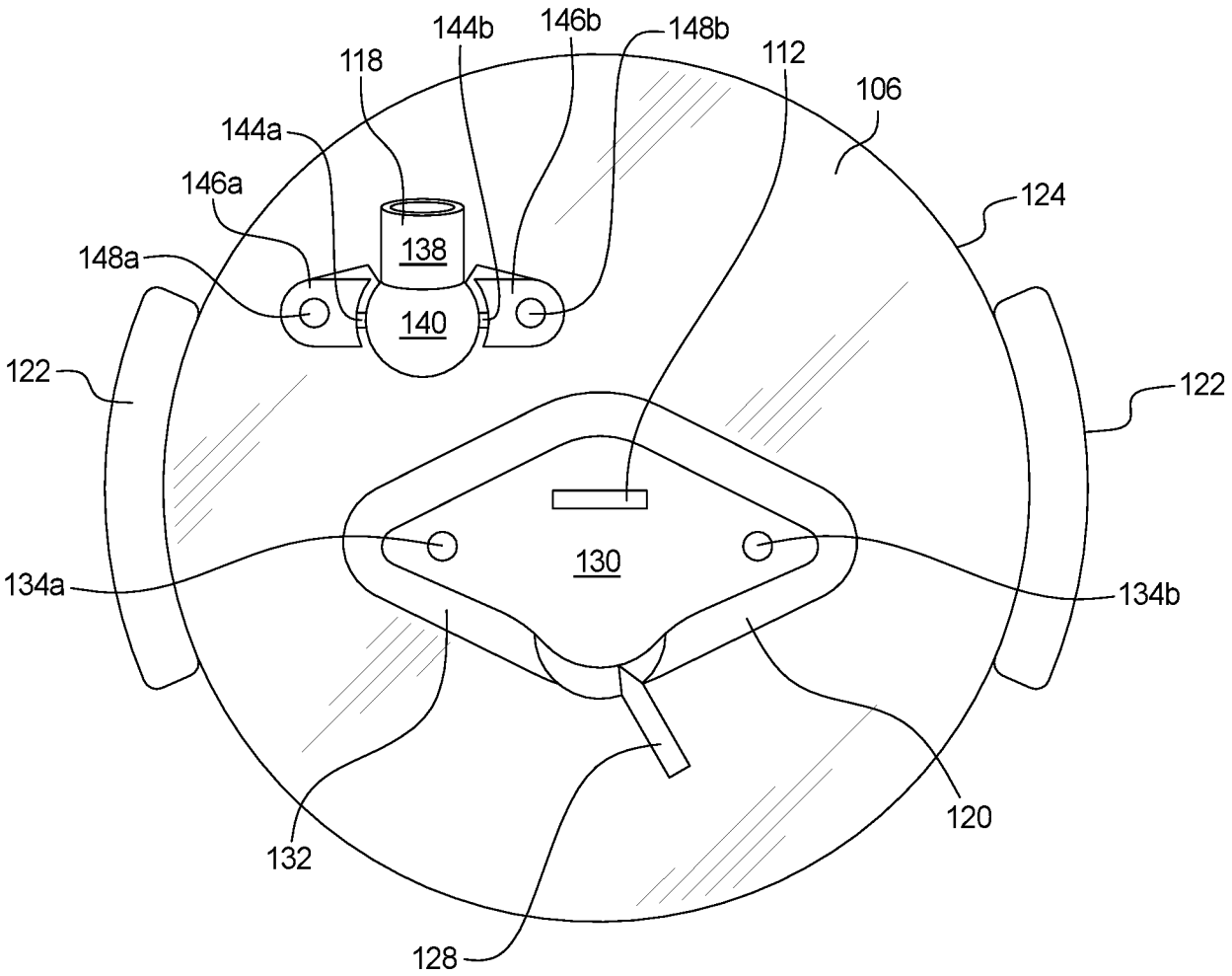
FIGS. 3 and 4 are front and rear elevational views of the front member, respectively, of the system of FIG. 1.
Figure 4:
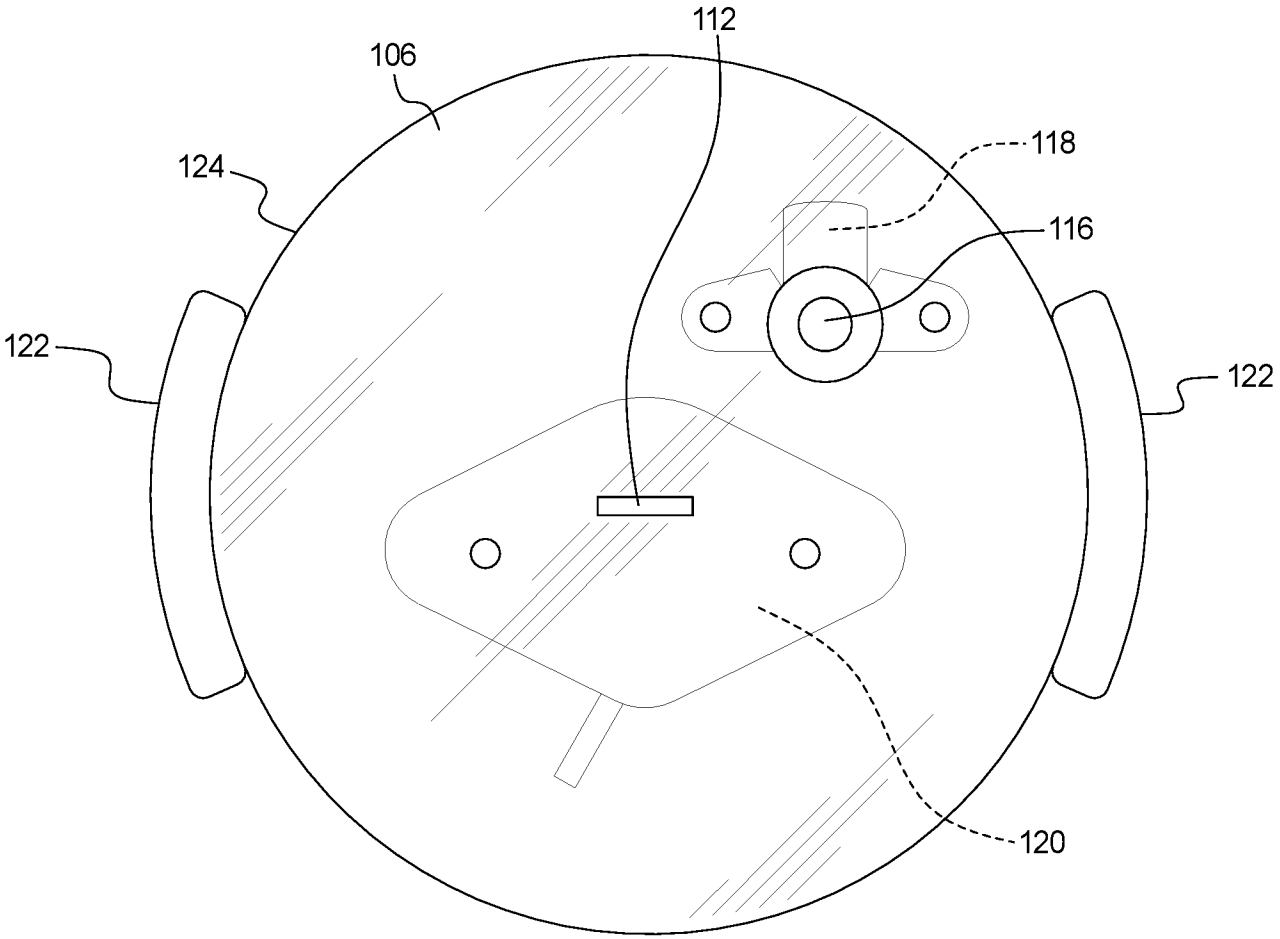
Figure 5:
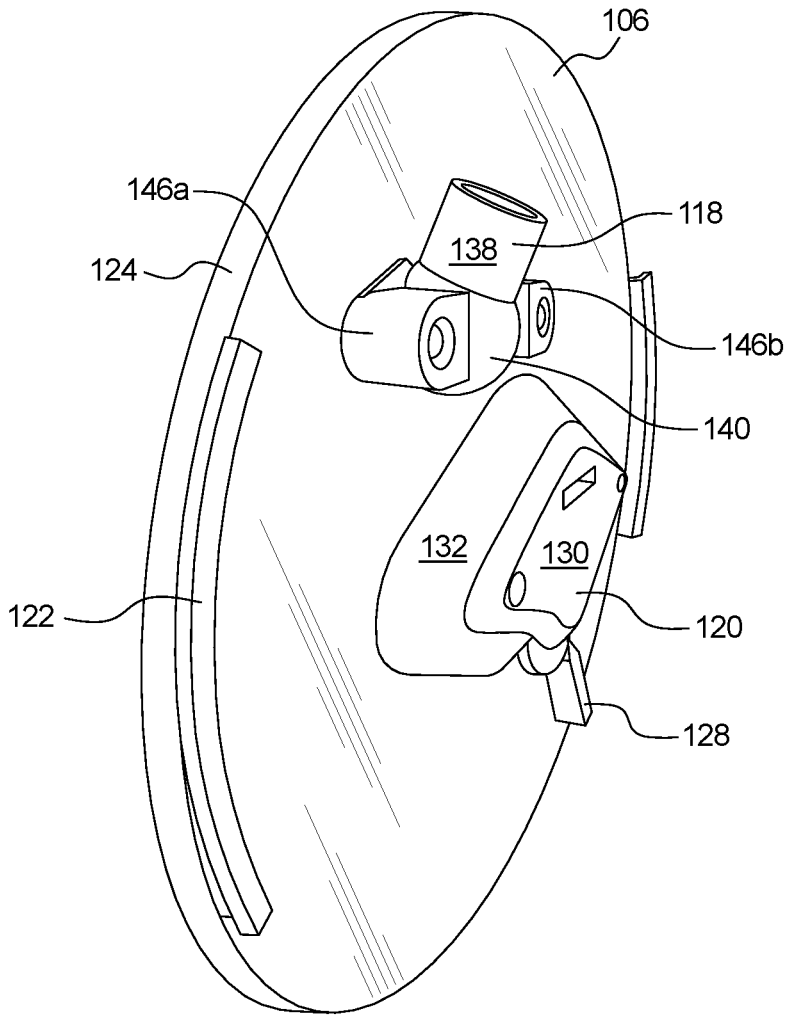
FIG. 5 is a perspective view of the front member of the system of FIG. 1.

As shown in FIGS. 3-5, the front member 106 is a solid piece of material with a slot or opening 112 through which a handle 114 (FIG. 2) extends and an orifice 116 for filling the mold with compound. A fill channel or port 118 attached to the front member 106 around the orifice 116 allows for loading of the compound into the mold and serves to close the port once filling is complete. A locking mechanism 120 secured to the front member 106 around the slot 112 that secures the front member 106 to the handle 114. In the illustrated embodiment, flanges 122 are provided along an outer edge 124 of the front member 106 so that the user can easily grasp the front member 106, particularly when the front member 106 is flush up against the front surface 110 of the wall 104. In the illustrated embodiment, the front member 106 is comprised of a transparent material so that the user can monitor the filling of the hole.

Figure 6B:
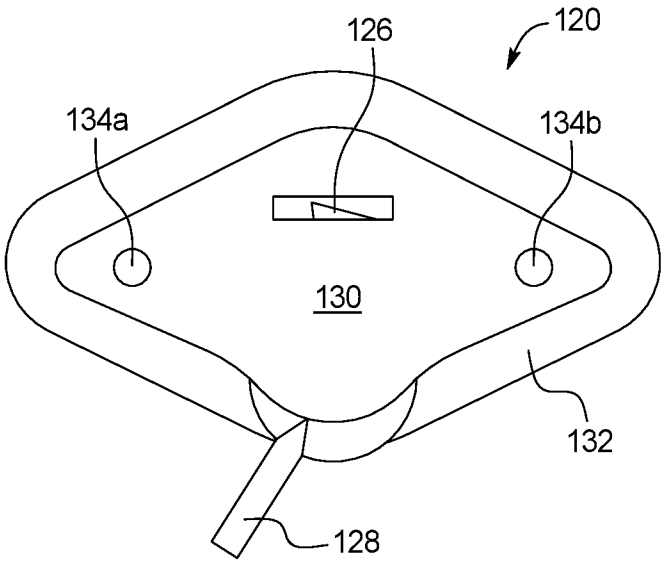
FIGS. 6A and 6B are front elevational views of a locking mechanism of the front member of FIG. 3 in the unlocked and locked positions, respectively.
Figure 6A:
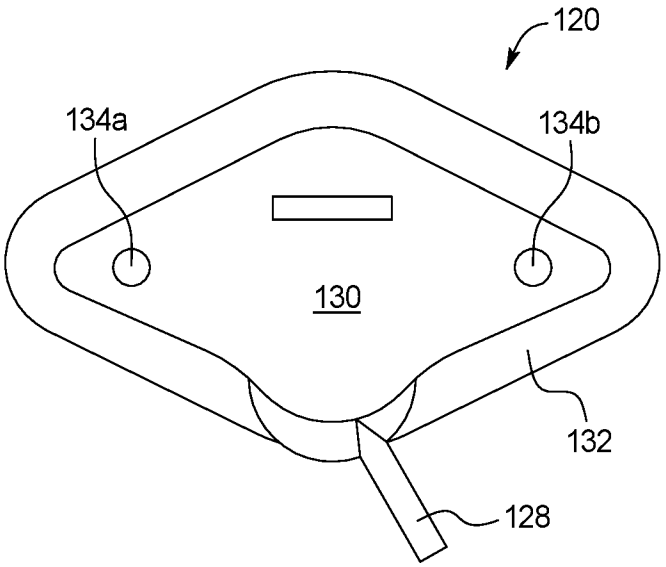
Figure 6D:
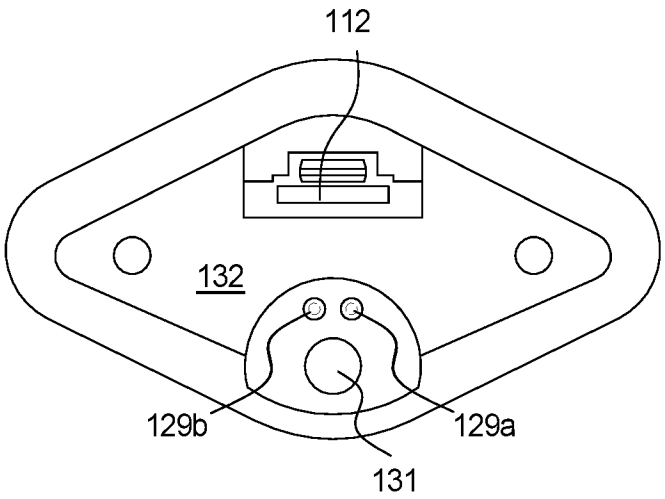
FIG. 6D is a front elevational view of the base of FIG. 6C.
Figure 6C:
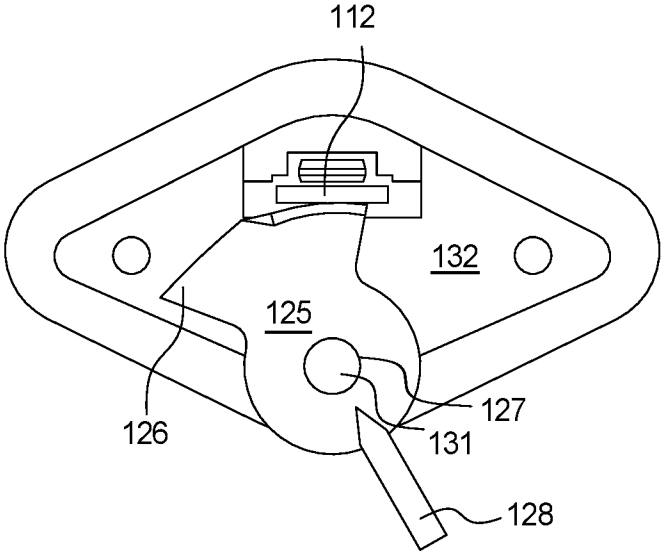
FIG. 6C is a front elevational view of a base and a cam component of the locking mechanism of FIG. 6A.
Figure 6E:
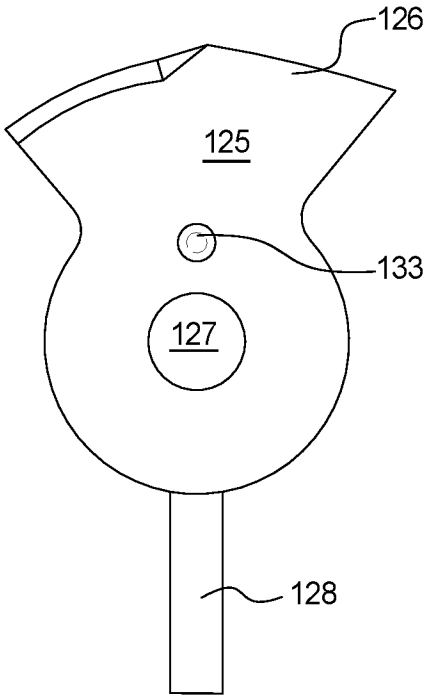
FIG. 6E is a rear elevational view of the cam component of FIG. 6C.

Referring to FIGS. 6A and 6B, the locking mechanism 120 includes a cam component 125 including a latch 126 formed integrally with an arm 128 that moves between an unlocked position shown in FIG. 6A and a locked position shown in FIG. 6B. Specifically, the cam component 125 is positioned between a cover 130 that is tightly secured to a base 132. Seen best in FIGS. 6C-6E, a post 131 extends from the base 132 through an opening 127 formed in the cam component 125. The cam component 125 pivots about the post 131 of the base 132 between the locked and unlocked positions.

Specifically, the base 132 includes first and second depressions 129*a*, 129*b* (FIG. 6D) that receive a protrusion 133 (FIG. 6E) on the cam component 125. Positioning of the protrusion 131 of the cam component 125 in one of the first and second depressions 129*a*, 129*b* corresponds to the locked and unlocked positions, respectively. The arm 128 extends downwardly from the cover 130 so that movement of the arm 128 causes the latch 126 to move between the locked and unlocked positions. First and second fasteners 134*a*, 134*b* such as screws are inserted through the cover 130 and the base 132 into the front member.

Figure 7B:
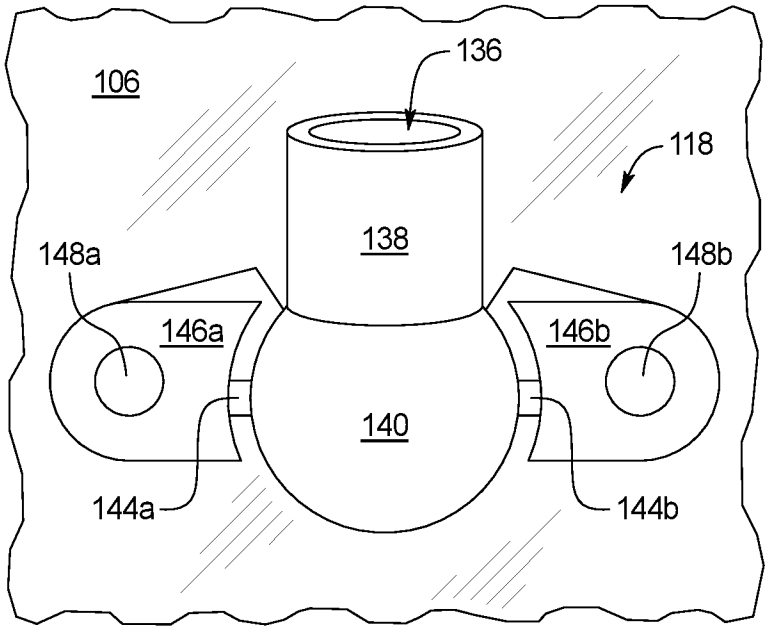
FIGS. 7A and 7B are front elevational views of a closable fill channel of the front member of FIG. 3 in the open and closed positions, respectively.
Figure 7A:
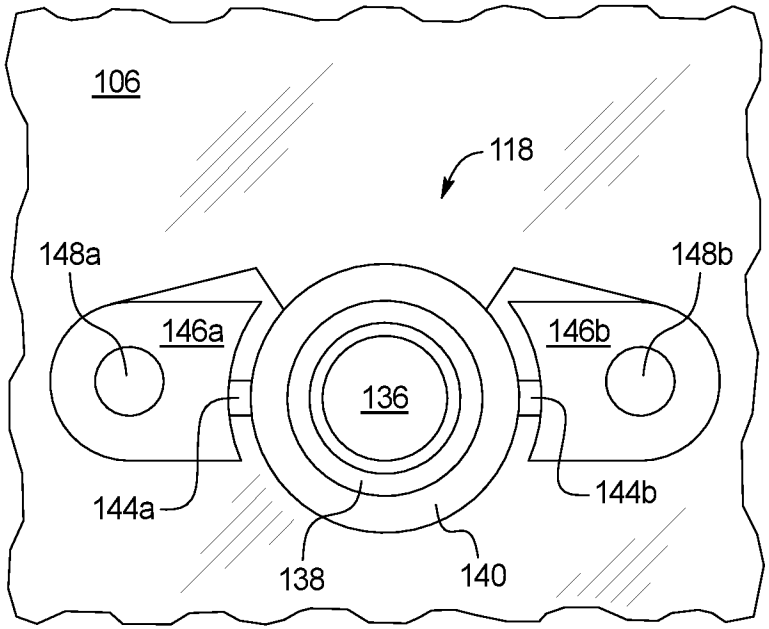
Figure 8B:
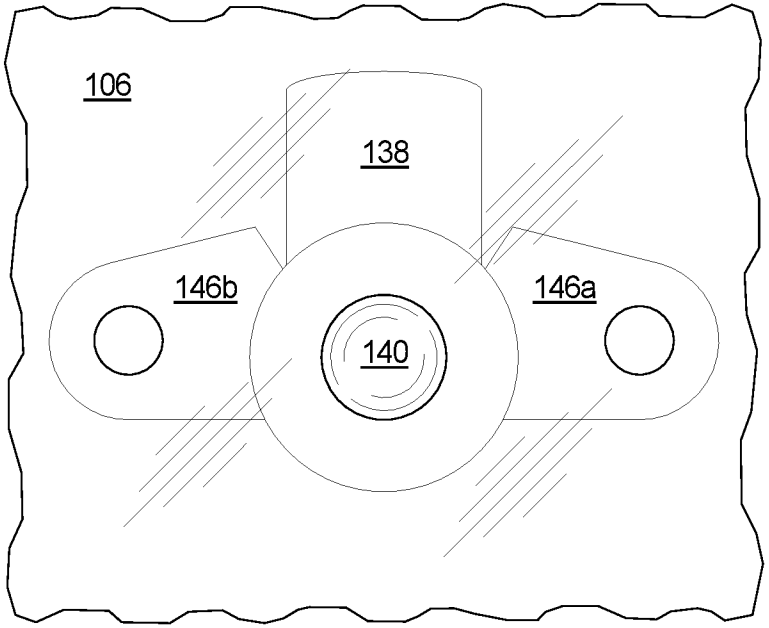
FIGS. 8A and 8B are rear elevational views of the closable fill channel of FIGS. 7A and 7B in the open and closed positions, respectively.
Figure 8A:
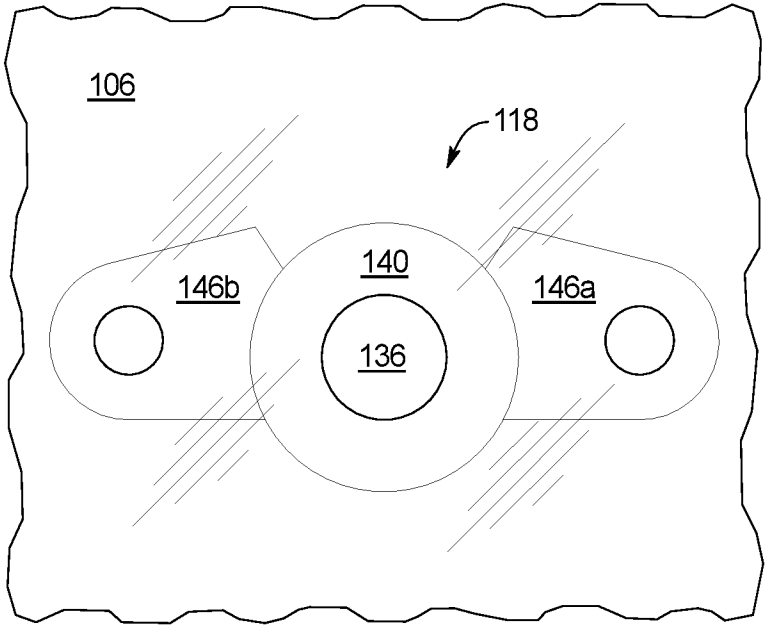
Figure 9A:
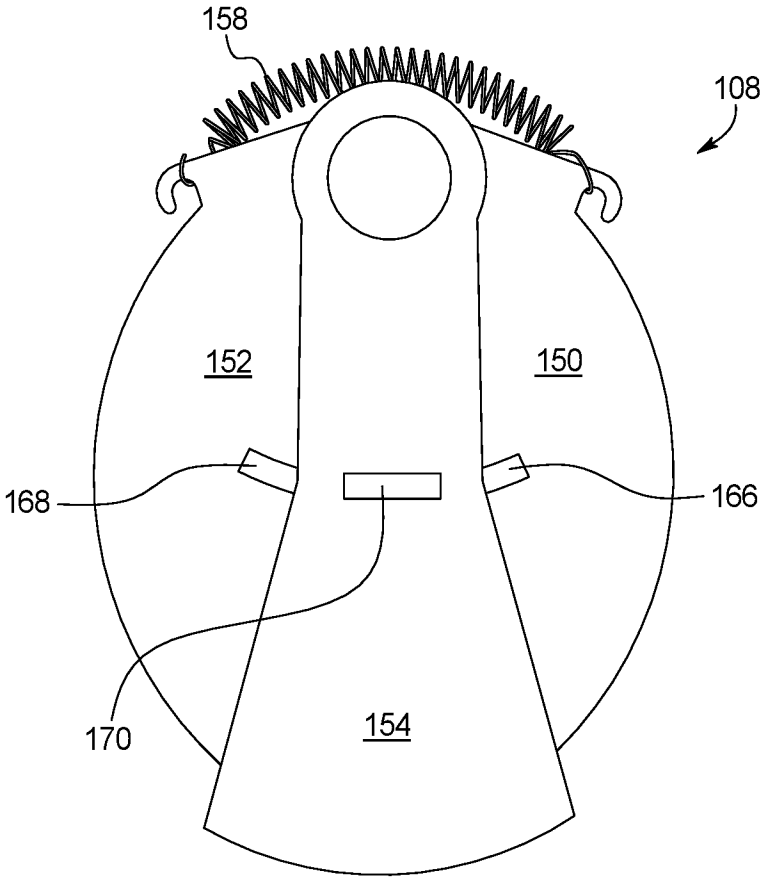
FIGS. 9A and 9B are front elevational views of the rear member of the system of FIG. 1 in the compact and expanded positions, respectively.
Figure 9B:
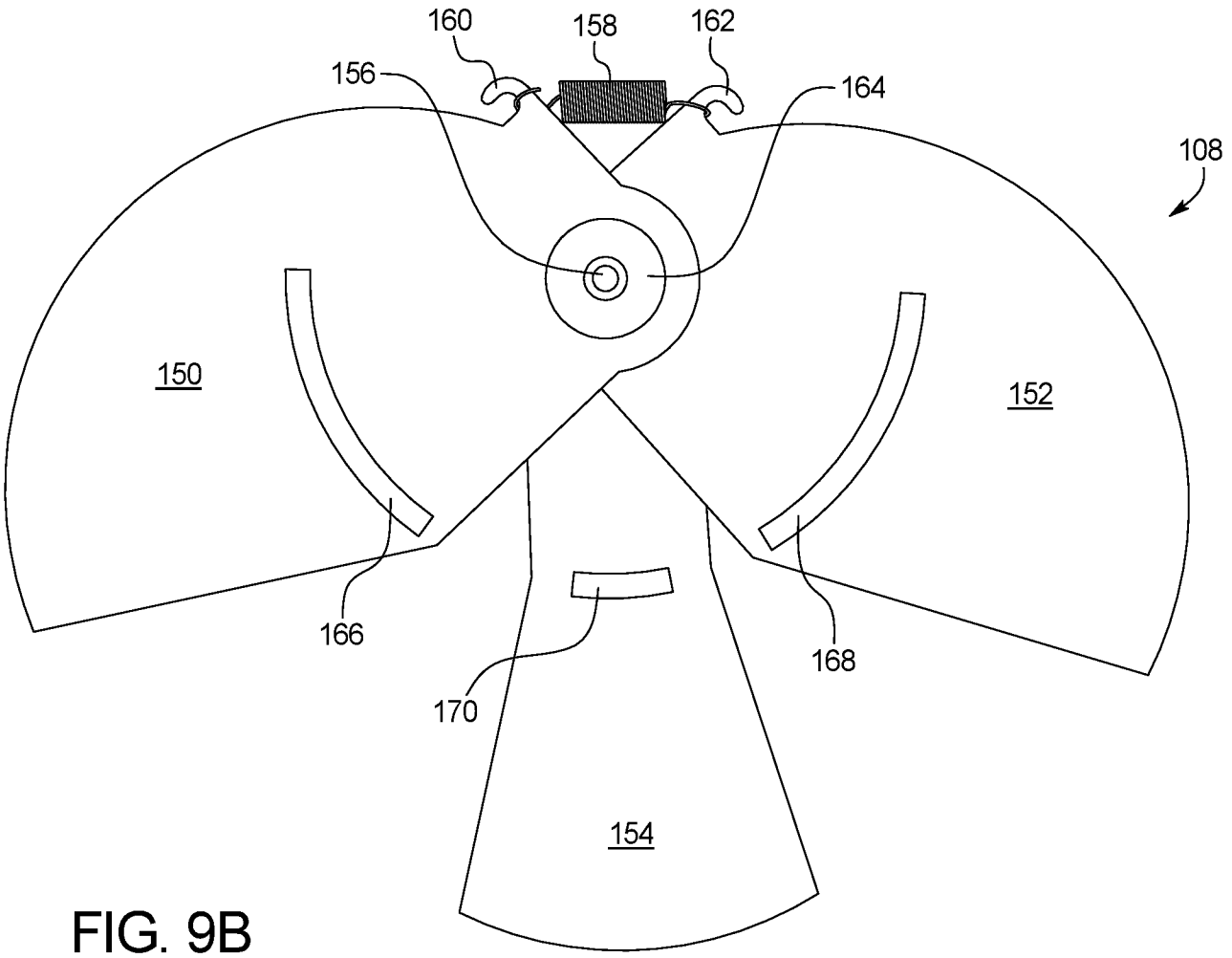

Referring to FIGS. 7A-8B, the closable fill channel 118 rotates between an open position shown in FIGS. 7A and 8A and a closed position shown in FIGS. 7B and 8B. The fill channel 118 includes a bore 136 extending through a coupler portion 138 formed integrally with a rounded base 140. Seen best in FIG. 4, a side wall 142 of the orifice 116 is angled and rounded to receive the rounded base 140 of the fill channel 118 and allow for rotation of the rounded base 140 within the orifice 116. First and second arms 144*a*, 144*b* protruding from the rounded base 140 are received by first and second supports 146*a*, 146*b*, respectively, on opposing sides of the orifice 116. The rounded base 140 rotates about the first and second arms 144*a*, 144*b* so that the bore 136 can be aligned with the orifice 116 in the open position. First and second fasteners 148*a*, 148*b* secure the fill channel 118 to the front member 106. The pivoting fill channel 118 allows for the user to quickly shut off the filling of the compound, minimizing surface distortion and increasing speed as well as ease of use.

With the fill channel 118 in the open position, the user inserts a tip 147 of a container 149 (see FIG. 1) of the compound into the coupler portion 138 and fills the mold with the compound. When the mold is filled, the user removes the tip 147 from the fill channel 118 and rotates the coupler portion 138 and rounded base 140 into the closed position, forming a smooth and clean finish on the surface of the compound.

Referring to FIGS. 9A-10B, the back member 108 includes first and second outer portions 150, 152 and a central portion 154 that are conjoined at a pivot point 156. A spring 158 extends between first and second hooks 160, 162 on the first and second outer portions 150, 152, respectively, adjacent the pivot point 156 so that the first and second outer portions 150, 152 move between a compressed position shown in FIG. 9A and an expanded position shown in FIG. 9B. The pivot point 156 may be formed by a fastener 164 extending through aligned openings (not shown) of the first through third portions 150, 152, 154 so that the portions 150, 152, 154 are rotatable about the fastener 164. In the compressed position of FIG. 9A, the first through third portions 150, 152, 154 overlap one another to minimize a width of the back member 108 so that it can be inserted through the hole 102 easily. The back member 108 may be made of any suitable material such as plastic or metal. In some embodiments, the back member 108 comprises a metallic material to increase the flame retardant properties of the system 100.

Figure 10B:
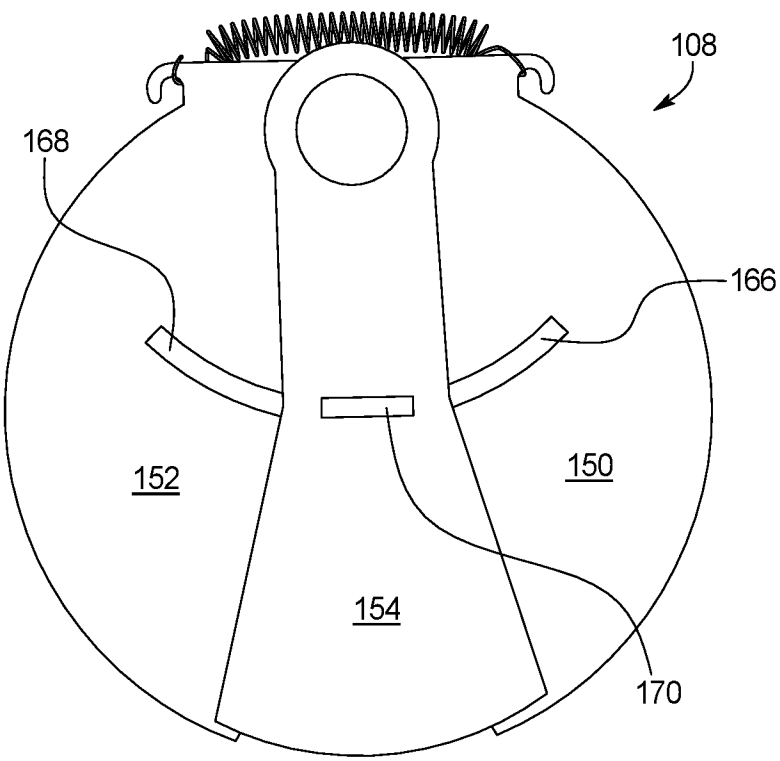
FIGS. 10A and 10B are front and rear elevational views, respectively, of the rear member of the system of FIG. 1 in the restricted position.
Figure 10A:
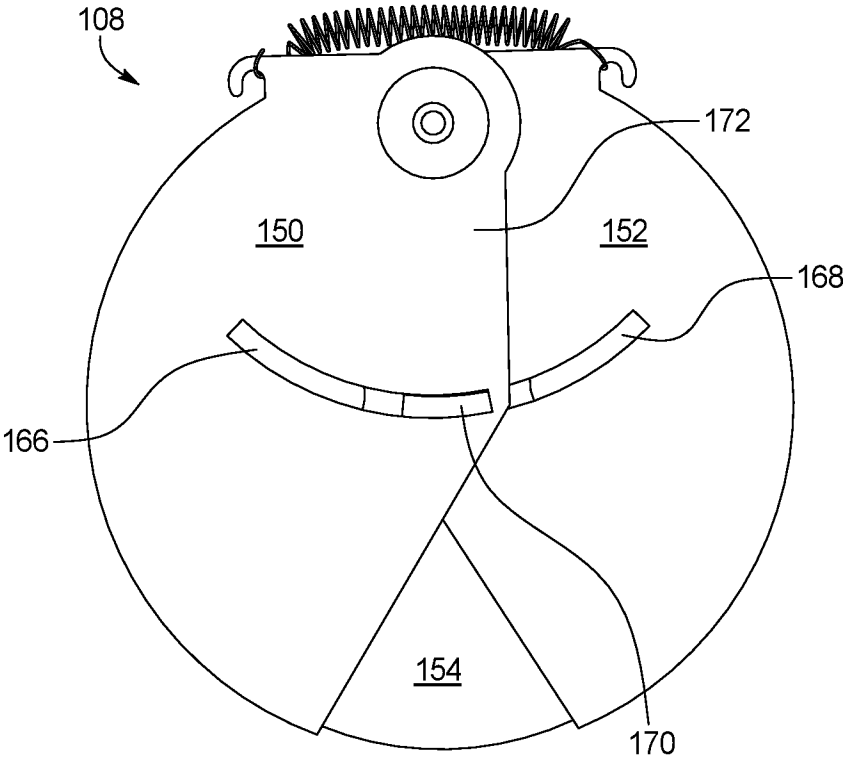

Seen best in FIGS. 10A and 10B, each of the first and second outer portions 150, 152 include first and second elongated slots 166, 168, respectively, that are aligned with a slot 170 on the central portion 154. When an item such as the handle 114 is inserted through the aligned slots 166, 168, 170, the first and second outer portions 150, 152 are biased by the spring 158 away from the central portion 154 but restricted by the handle 114 within the slots 166, 168, 170 in a restricted position so as to form a continuous surface 172. Holding the handle 114 parallel to wall 104 and the rear member 108 perpendicular to the wall 104, the rear member 108 is pushed through the hole 102 and will automatically compress to the position of FIG. 10A, the first and second outer portions 150, 152 will release automatically and expand to maximum width, forming the restricted position. In the restricted position, the continuous surface 172 of the back member 108 operates in conjunction with the front member 106 to form the mold as shown in FIGS. 1 and 2.

In the embodiment illustrated in FIGS. 10A and 10B, the first through third portions 150, 152, 154 approximate the shape of a circle in the restricted position. As seen in the expanded position of FIG. 9B, each of the first and second outer portions 150, 152 is shaped slightly larger than a sector of a circle. The central portion 154 is shaped to complete the remainder of the circle with the first and second outer portions 150, 152 are in the restricted position. While the illustrated embodiment forms a circle, the portions may be shaped to form any geometric shape as desired.

Figure 11A:
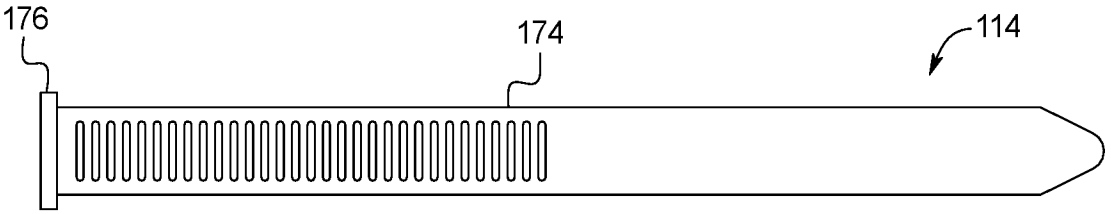
FIGS. 11A and 11B are front and side views, respectively, of a handle of the system of FIG. 1.
Figure 11B:
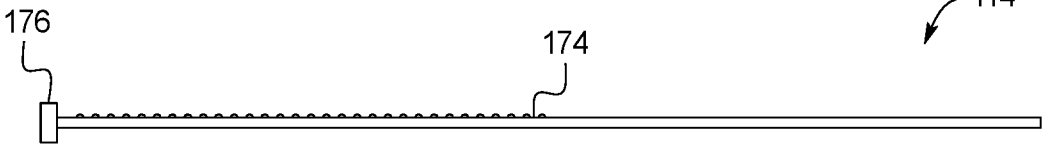

Referring to FIGS. 11A and 11B, the device includes a handle 114 that is threaded through the slots 166, 168, 170 of the back member 108 and allows the user to manipulate and position the back member 108 relative to the wall 104 during use. The handle 114 includes a body 174 extending from a head 176. The body 174 is threaded through the slots 166, 168, 170 until the head 176 sits up against an outer side 178 (FIG. 2) of the back member 108. The front member 106 is then positioned on the body 174 of the handle 114 so that the body 174 is threaded through the opening 112 of the front member 106 and the locking mechanism 120. The handle 114 may also be a cable tie, a zip tie with a nylon tape portion extending from a ratchet end, or any other suitable grasping means.

Once the mold is formed, it is then filled with a compound such as spackle, plaster, a polyurethane foam, or other similar filling material. The compound may be provided in a tube, an aerosol can, or any other container including a tip through which the compound is expelled. In some embodiments, the urethane foam may be a single component foam or a multiple component foam. For example, a conventional two-component polyurethane foam includes two separate parts that expand upon mixing. The two-component polyurethane foam may be provided in a container including a separation between the two parts by a membrane or other similar structure that is punctured or broken allowing the mixing of substances upon use. In other embodiments, the polyurethane foam may be provided in an aerosol can or manually expelled from a tube. The foam may be propelled into the mold via a nozzle, a straw, or a tip from either an aerosol can or a multiple compartment pouch. In some embodiments, the foam may be a fire-rated foam in order to increase the flame retardant properties of the system 100.

Operation of the system 100 will now be described. For demonstrative purposes, the following methodology describes use of the system 100 to fill a hole 102 within a wall 104, although the system may be used on a variety of structures. With the handle 114 parallel to wall 104 and the rear member 108 perpendicular to the wall 104, the user pushes the back member 108 through the hole 102 so that it automatically moves into the compressed position. Once the rear member 108 clears the wall 104, the first and second outer portions 150, 152 release automatically and expand to maximum width forming the restricted position. In the restricted position, the continuous surface 172 of the back member 108 operates in conjunction with the front member 106 to form the mold as shown in FIGS. 1 and 2. Using the handle 114 to move the rear member 108, the user positions the back member 108 so that it spans the rear surface surrounding the hole 102.

Next, the user threads the body 174 of the handle 114 through the opening 112 and the locking mechanism 120 of the front member 106 and positions the front member 106 against the front surface of the wall 104 surrounding the hole 102. The user moves the arm 128 of the locking mechanism 120 so that the latch 126 tightly presses the body 174 of the handle 114 against the locking mechanism 120, securing the front member 106 to the handle 114. The front and rear members 106, 108 positioned in place around the hole 102 define the mold for receiving the filler compound. The user then moves the fill channel 118 of the front member 106 into the open position, inserts the tip of the compound container into the fill channel 118, and loads the compound into the mold. Once the mold is filled, the user removes the tip from the fill channel and rotates the fill channel 118 into the closed position.

With the compound at least partially cured, the user moves the arm 128 of the locking mechanism 120 of the front member 108 into the unlocked position and removes the front member 108 from the handle 114 so that the exposed surface of the filled hole is coplanar with the surrounding wall 104. Once the compound has cured, the user then cuts the handle 114 at the exposed surface of the filled hole using a knife, razor blade, or other cutting device, pushes the remainder of the handle 114 slightly into the mold, and fills any resulting cavity with compound.

It should be noted that various changes and modifications to the presently preferred embodiments described herein will be apparent to those skilled in the art. Such changes and modifications may be made without departing from the spirit and scope of the present invention and without diminishing its attendant advantages.

We claim:

1. A system for fixing an opening within a structure comprising:

a planar front member including an opening, a rear member including first and second outer portions connected at a pivot point, wherein the first and second outer portions include first and second hooks, respectively, surrounding an adjacent pivot point, wherein a spring may extend between the first and second hooks, and wherein at least the first and second portions include first and second elongated slots, wherein at least the first and second portions are rotatable about the pivot point along parallel planes, so that in a compressed position, the portions overlap so that the width of the back member is reduced so it can be inserted through the opening easily, a handle including a body, wherein the body of the handle is threaded through the slots of the rear member and the opening of the front member.

2. The system of claim 1, wherein the front member includes a locking mechanism surrounding the opening that engages the handle.

3. The system of claim 2, wherein the locking mechanism comprises a latch between a cover secured to a base, wherein the latch rotates about a fastener between locked position and an unlocked position.

4. The system of claim 1, wherein the front member includes an orifice and a fill channel adjacent the orifice.

5. The system of claim 4, wherein the orifice receives a rounded base of a fill port.

6. The system of claim 5, wherein the fill channel comprises:

a coupling portion integral with the rounded base, including a bore extending therethrough;

first and second supports positioned on opposing sides of the orifice;

first and second arms extending outwardly from the rounded base into the first and second supports, respectively.

7. A system for fixing an opening within a structure comprising:

a front member having a planar surface and including an opening, a rear member including first and second outer portions connected at a pivot point, wherein the first and second outer portions include first and second hooks, respectively, surrounding an adjacent pivot point, wherein a spring may extend between the first and second hooks, and wherein at least the first and second portions include first and second elongated slots, wherein at least the first and second portions are rotatable about the pivot point along parallel planes, so that in a compressed position, the portions overlap so that the width of the back member is reduced so it can be inserted through the opening easily, a handle including a body, wherein the first and second outer portions of the rear member form a continuous surface when the handle is threaded through the first and second elongated slots of the first and second outer portions of the rear member.

8. A method for filling an opening within a structure, comprising the steps of:

providing a system including:

a planar front member including an opening for a handle and an orifice for loading compound into the hole, a rear member including first and second outer portions connected at a pivot point, wherein the first and second outer portions include first and second hooks, respectively, surrounding the adjacent pivot point, wherein a spring may extend between the first and second hooks, and wherein at least the first and second portions include first and second elongated slots, wherein at least the first and second portions are rotatable about pivot point along parallel planes, so that in a compressed position, the portions overlap so that the width of the back member is reduced so it can be inserted through the opening easily and a handle including a body, align first and second elongated slots of the first and second outer portions, respectively, and the slot of the central portion, then inserting the handle trough the first and second elongated slots of the first and second outer portions, respectively, pushing the rear member through the opening where the rear plate is capable of being compressed to fit within the opening pushing the rear member clear of the opening so that the first and second outer portions are released and expand outwardly to form a continuous surface;

manipulating the handle to position the back member against a rear surface of the structure;

threading the body of the handle through the opening of the front member;

positioning the front member against a front surface of the structure;

filling compound into the hole through the orifice on the front member;

once the hole has been filled, moving the front member off of the handle;

and cutting the handle.

9. The method of claim 8, wherein the front member includes a locking mechanism surrounding the opening, and wherein the method further comprises the step of locking the front member onto the handle after the front member is positioned against the front surface of the structure.

* * * * *